US009062581B2

(12) United States Patent
Usa et al.

(10) Patent No.: US 9,062,581 B2
(45) Date of Patent: Jun. 23, 2015

(54) EXHAUST-GAS MUFFLER

(75) Inventors: Masanori Usa, Wako (JP); Tsuyoshi Mochizuki, Wako (JP); Makoto Nishioka, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 515 days.

(21) Appl. No.: 13/364,319

(22) Filed: Feb. 2, 2012

(65) Prior Publication Data

US 2012/0210701 A1 Aug. 23, 2012

(30) Foreign Application Priority Data

Feb. 17, 2011 (JP) ..... 2011-031579

(51) Int. Cl.

| | |
|---|---|
| ***F01N 3/10*** | (2006.01) |
| ***F01N 3/00*** | (2006.01) |
| ***F01N 1/16*** | (2006.01) |
| ***F01N 1/08*** | (2006.01) |

(52) U.S. Cl.

CPC *F01N 1/16* (2013.01); *F01N 1/089* (2013.01); *F01N 1/163* (2013.01); *F01N 1/166* (2013.01); *F01N 2230/04* (2013.01); *F01N 2290/10* (2013.01); *F01N 2490/06* (2013.01); *F01N 2490/08* (2013.01); *F01N 2590/04* (2013.01)

(58) Field of Classification Search

CPC ..... F01N 1/089; F01N 1/163; F01N 1/166; F01N 2230/04; F01N 2490/06; F01N 2590/04; F01N 3/2885; F01N 1/084; F01N 1/165; F01N 1/16; F01N 2290/10; F01N 2490/08

USPC ..... 60/299; 181/228; 137/535, 537, 527, 137/527.2, 527.4, 527.6; 251/337

See application file for complete search history.

(56) References Cited

U.S. PATENT DOCUMENTS

| | | | | |
|---|---|---|---|---|
| 5,723,827 | A | 3/1998 | Sasaki et al. | |
| 6,338,246 | B2 * | 1/2002 | Eguchi et al. | 60/324 |
| 6,637,449 | B2 * | 10/2003 | Nagai et al. | 137/15.18 |
| 6,736,160 | B2 * | 5/2004 | Nagai et al. | 137/527.6 |
| 2002/0005318 | A1 * | 1/2002 | Schumacher et al. | 181/237 |
| 2003/0000208 | A1 * | 1/2003 | Knight et al. | 60/299 |

(Continued)

FOREIGN PATENT DOCUMENTS

| | | |
|---|---|---|
| EP | 1939416 | 7/2008 |
| JP | 2007-321595 | 12/2007 |

OTHER PUBLICATIONS

Machine English translation of JP 2007-321595.*

(Continued)

*Primary Examiner* — Audrey K Bradley
*Assistant Examiner* — Jason Sheppard
(74) *Attorney, Agent, or Firm* — Mori & Ward, LLP

(57) ABSTRACT

An exhaust-gas muffler includes a casing and a relief valve. The relief valve is provided to open when a pressure of an upstream exhaust-gas chamber is equal to or higher than a predetermined value. The relief valve includes a shutter, a spring, and a seal member. The shutter member is provided to face an open end of a gas passage provided between an upstream exhaust-gas chamber and a downstream exhaust-gas chamber. The spring is to bias the shutter member in a direction in which the gas passage is closed. The seal member is disposed on a downstream side of the gas passage. The seal member is made of a metal mesh material and has a disc shape to cover the open end of the gas passage.

6 Claims, 11 Drawing Sheets

(56) References Cited

U.S. PATENT DOCUMENTS

2006/0150619 A1 7/2006 Shiga et al.
2008/0236941 A1* 10/2008 Ishikawa et al. ..... 181/228

OTHER PUBLICATIONS

European Search Report for corresponding EP Application No. 12152705, May 23, 2012.

* cited by examiner

EXHAUST-GAS MUFFLER

CROSS-REFERENCE TO RELATED APPLICATIONS

The present application claims priority under 35 U.S.C. §119 to Japanese Patent Application No. 2011-031579, filed Feb. 17, 2011. The contents of this application are incorporated herein by reference in their entirety.

BACKGROUND OF THE INVENTION

1. Field of the Invention

The present invention relates to an exhaust-gas muffler.

2. Discussion of the Background

An exhaust-gas muffler configured as follows has been known from Japanese Patent Application Publication No. 2007-321595: in the exhaust-gas muffler, a relief valve is provided between an upstream exhaust-gas chamber and a downstream exhaust-gas chamber among a plurality of exhaust-gas chambers which are formed in a casing and through which exhaust gas flows sequentially, and includes a shutter member placed to face an open end of a gas passage between the upstream exhaust-gas chamber and the downstream exhaust-gas chamber, the open end of the gas passage being open to the downstream exhaust-gas chamber, a spring for biasing the shutter member in such a direction that the gas passage is closed, and a seal member fastened to the shutter member so as to be capable of coming in contact with the whole circumference of the open end of the gas passage to the downstream exhaust-gas chamber. In the exhaust-gas muffler, the seal member is formed into a ring shape corresponding to an open end of a tube member forming the gas passage to the downstream exhaust-gas chamber to reduce hammering sound produced by a closing action of the relief valve.

SUMMARY OF THE INVENTION

According to one aspect of the present invention, an exhaust-gas muffler includes a casing and a relief valve. The casing includes an upstream exhaust-gas chamber and a downstream exhaust-gas chamber. The upstream exhaust-gas chamber is provided on an upstream side of the downstream exhaust-gas chamber in a flow direction of the exhaust gas. The relief valve is provided between the upstream exhaust-gas chamber and the downstream exhaust-gas chamber in the casing. The relief valve is provided to open when a pressure of the upstream exhaust-gas chamber is equal to or higher than a predetermined value. The relief valve includes a shutter, a spring, and a seal member. The shutter member is provided to face an open end of a gas passage provided between the upstream exhaust-gas chamber and the downstream exhaust-gas chamber. The open end of the gas passage is open to the downstream exhaust-gas chamber. The spring is to bias the shutter member in a direction in which the gas passage is closed. The seal member is connected to the shutter member to come in contact with a whole circumference of the open end of the gas passage. The seal member is disposed on a downstream side of the gas passage. The seal member is made of a metal mesh material and has a disc shape to cover the open end of the gas passage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
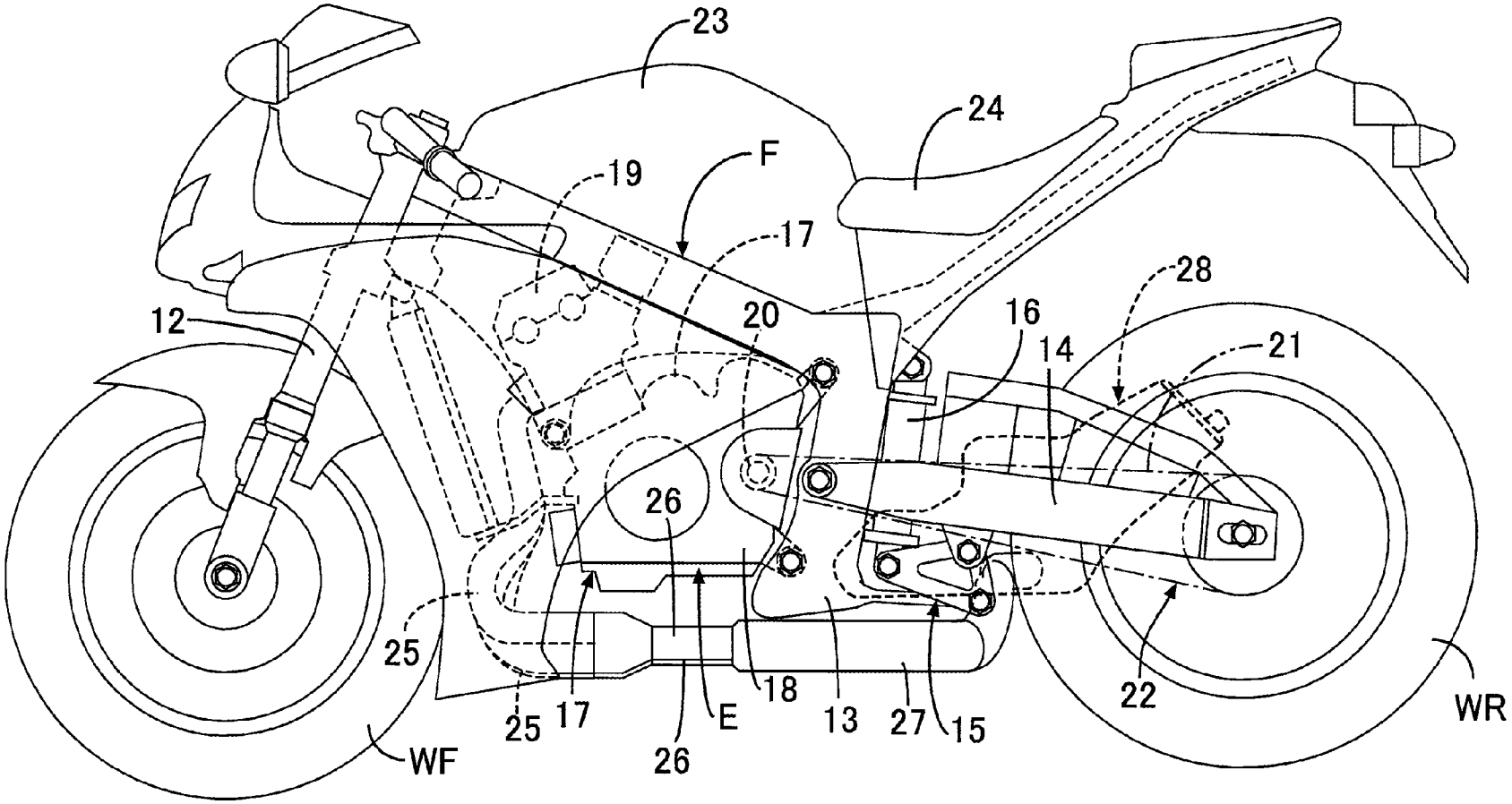
FIG. 1 is a side view of a motorcycle.

The embodiments will now be described with reference to the accompanying drawings, wherein like reference numerals designate corresponding or identical elements throughout the various drawings.

An embodiment of the present invention will be described with reference to the accompanying FIGS. 1 to 11. First, in FIG. 1, by a front end portion of a body frame F of this motorcycle, a front fork 12 pivotally supporting a front wheel WF is movably supported so that steering can be performed. Moreover, the body frame F includes a pivot plate 13 in an intermediate portion in the longitudinal direction thereof. The pivot plate 13 supports a front end portion of a swing arm 14 in a vertically swingable manner. A rear end portion of the swing arm 14 pivotally supports a rear wheel WR. A rear cushion unit 16 is provided between a link mechanism 15, which is provided between the swing arm 14 and the pivot plate 13, and the body frame F.

An engine main body 17 of an engine E is mounted on the body frame F to be placed between the front wheel WF and the rear wheel WR. Chain-type driving means 22 including an endless chain 21 is provided between an output shaft 20 of a transmission (not shown) housed in a crankcase 18 of the engine main body 17 and the rear wheel WR.

A fuel tank 23, which is located above the engine main body 17, is mounted on the body frame F. A riding seat 24, which is located behind the fuel tank 23, is supported by a rear portion of the body frame F.

The engine E is a multi-cylinder engine, e.g., an in-line four-cylinder engine. An exhaust-gas system 25 of the engine E includes per-cylinder individual exhaust pipes 25, 25, . . . having upstream ends thereof connected to a front surface of a cylinder head 19 constituting part of the engine main body 17; a pair of first collective exhaust pipes 26, 26, each of which joins two of the individual exhaust pipes 25, 25, . . . together; a second collective exhaust pipe 27, which joins the first collective exhaust pipes 26, . . . together; and an exhaust-gas muffler 28, to which the second collective exhaust pipe 27 is connected. The exhaust-gas muffler 28 is placed to the right of the rear wheel WR.

Figure 2:
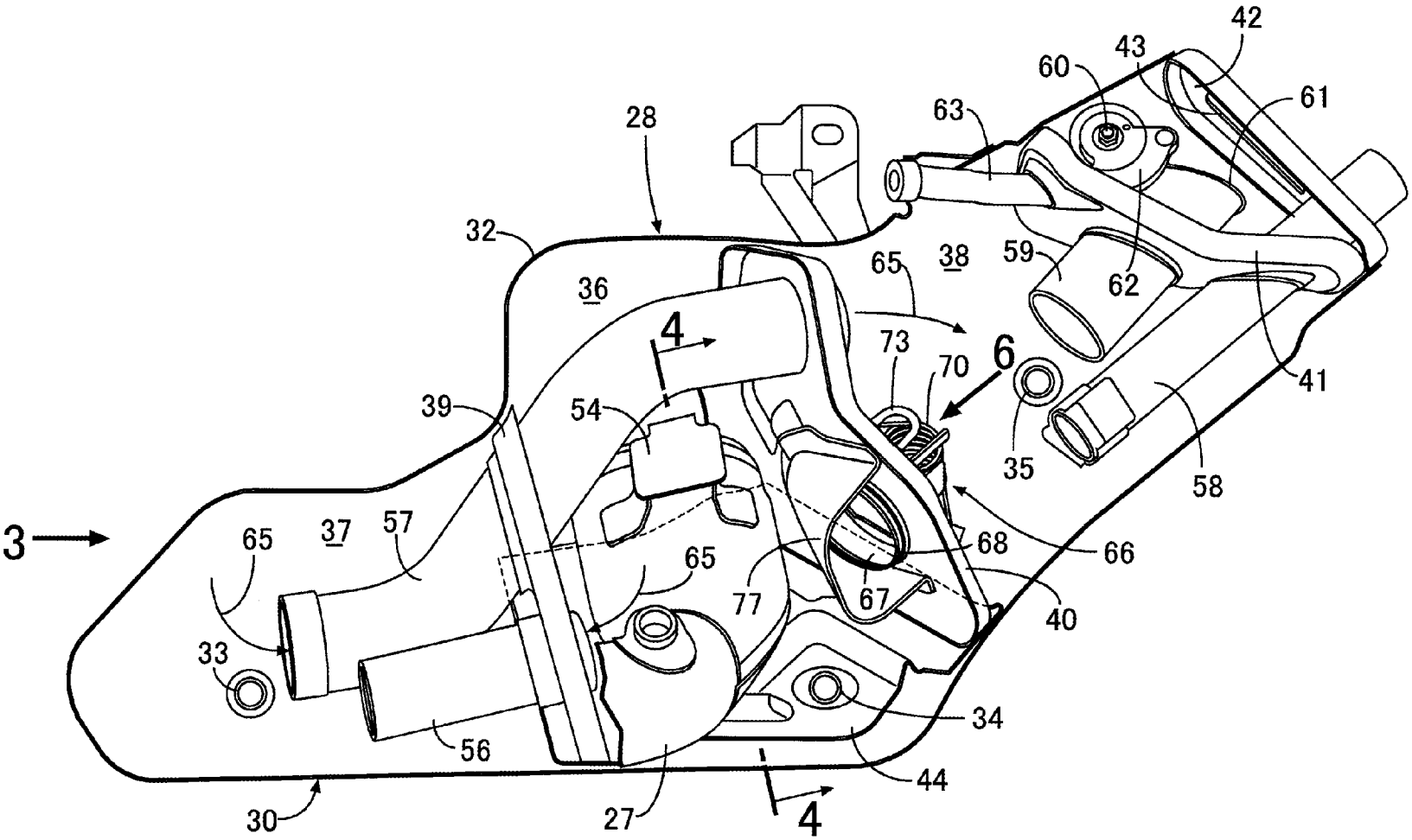
FIG. 2 is a longitudinal sectional side view of an exhaust-gas muffler.
Figure 3:
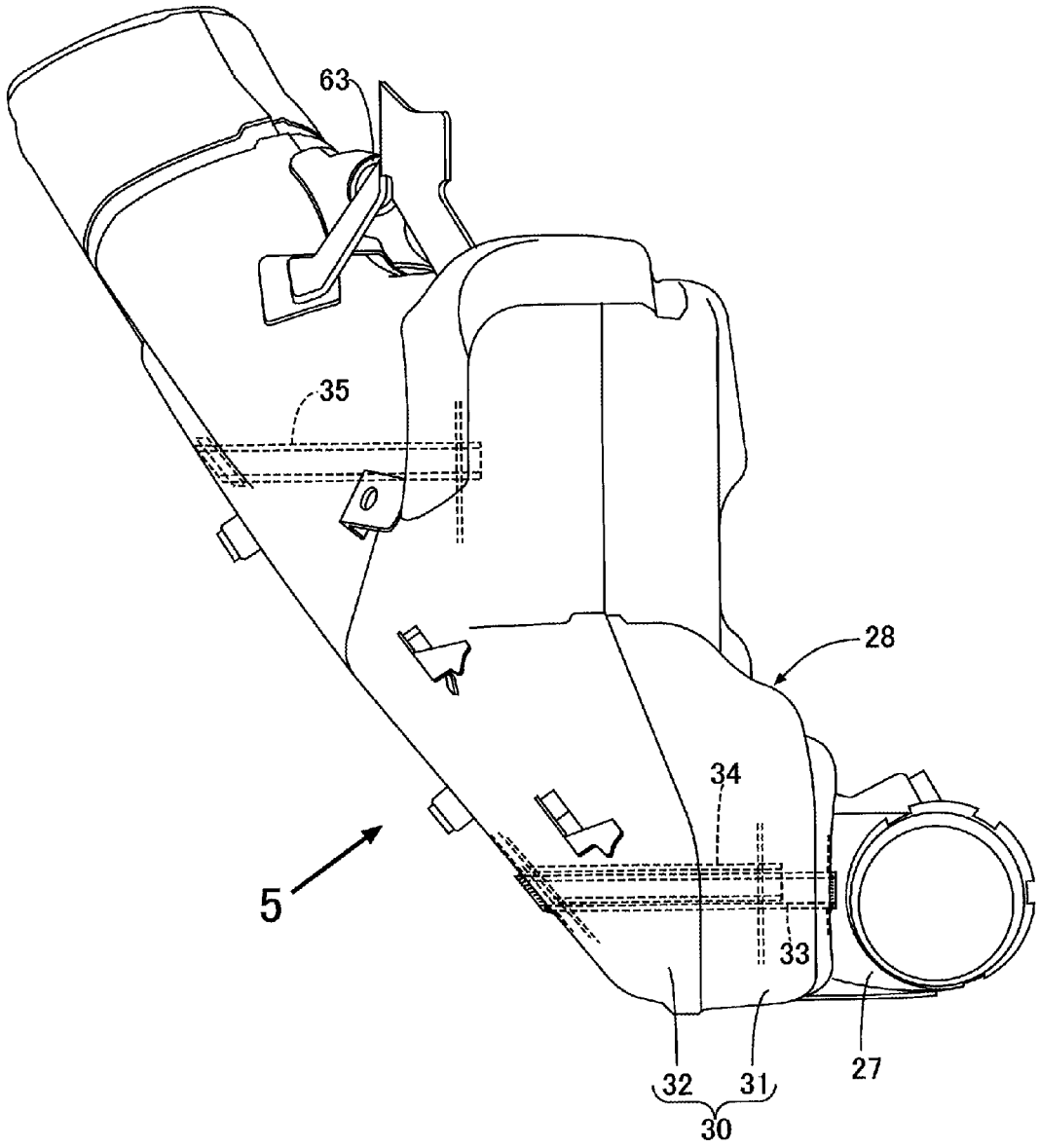
FIG. 3 is a front view of the exhaust-gas muffler as seen from the direction of arrow 3 of FIG. 2.

In FIGS. 2 and 3, a casing 30 of the exhaust-gas muffler 28 is formed by joining an inner case member 31 placed at an inner position in the vehicle width direction of the motorcycle and an outer case member 32 placed at an outer position in the vehicle width direction together by welding. A plurality of, e.g., three, cross pipes 33, 34, 35 are provided between the inner case member 31 and the outer case member 32. Moreover, in the casing 30, a plurality of exhaust-gas chambers through which exhaust gas introduced from the second collective exhaust pipe 27 is allowed to sequentially flow are formed. The plurality of exhaust-gas chambers are three exhaust-gas chambers in this embodiment, i.e., first to third exhaust-gas chambers 36, 37, 38. A plurality of separators, which are first to third separators 39, 40, 41 in this embodiment, are fixed to the casing 30, and partition the inside of the casing 30 to form the first to third exhaust-gas chambers 36, 37, 38.

The first exhaust-gas chamber 36 is formed in an intermediate portion of the casing 30 in the longitudinal direction thereof. The first separator 39 is placed between the second exhaust-gas chamber 37 formed in a front portion of the casing 30 and the first exhaust-gas chamber 36. The second separator 40 is placed between the third exhaust-gas chamber 38 formed in a rear portion of the casing 30 and the first exhaust-gas chamber 36. The third separator 41 forming the third exhaust-gas chamber 38 between the second separator 40 and the third separator 41 is fastened to a rear portion of the casing 30. Moreover, an end wall member 42 having an opening portion 43 is provided behind the third separator 41 in a rear end portion of the casing 30.

Figure 4:
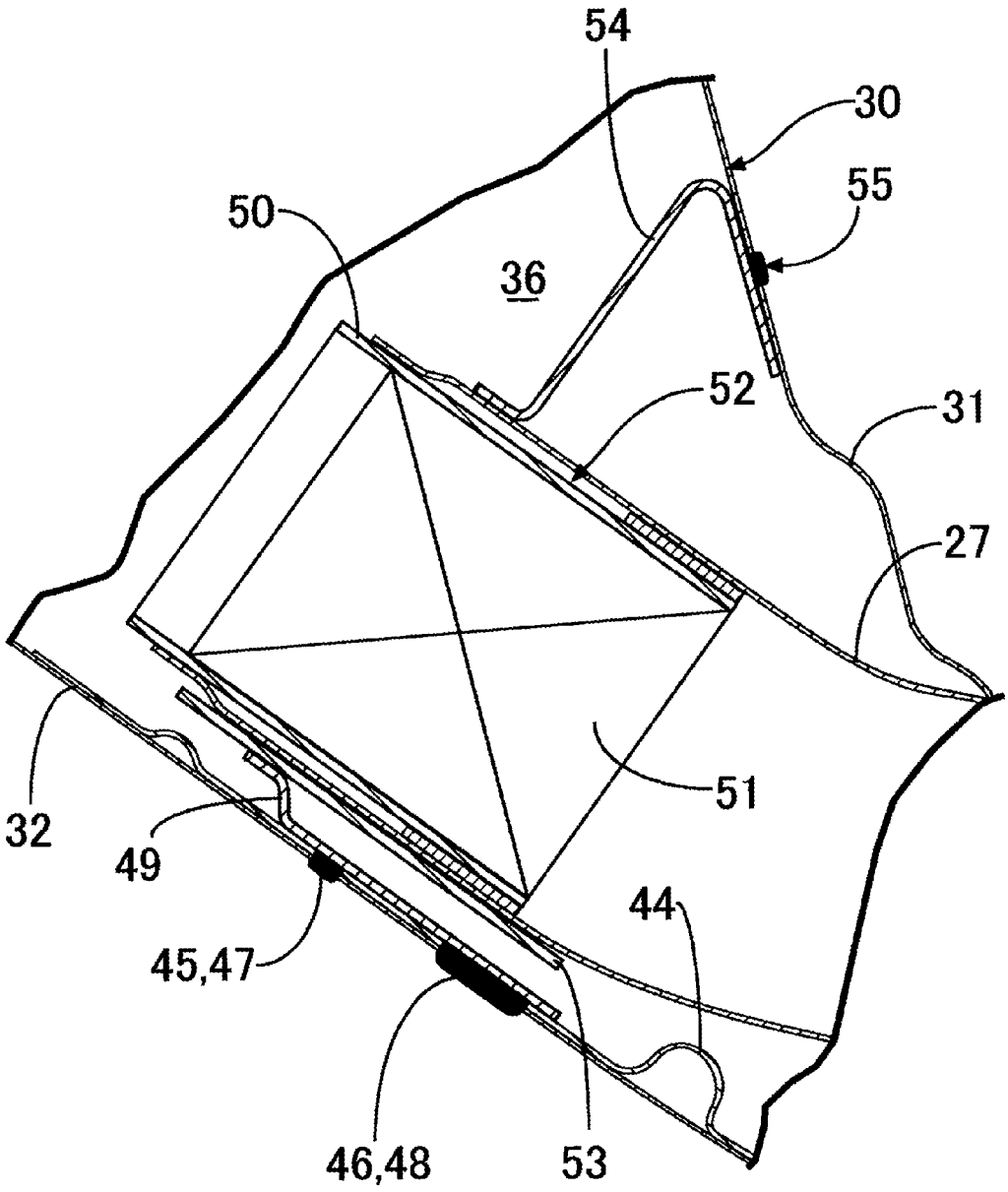
FIG. 4 is a cross-sectional view taken along line 4-4 of FIG. 2.
Figure 5:
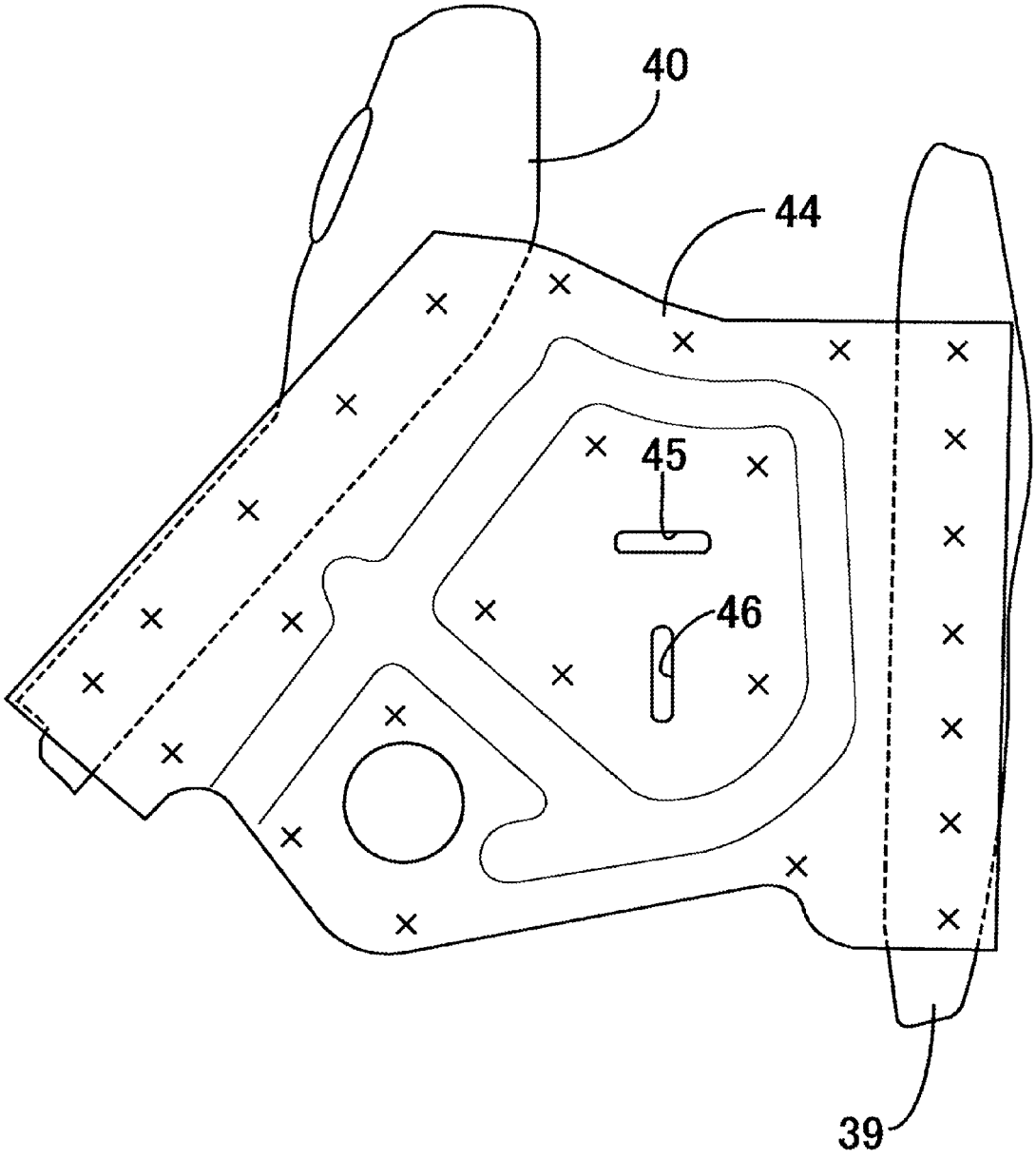
FIG. 5 is a view of a reinforcing plate member as seen from the direction of arrow 5 of FIG. 3.
Figure 6:
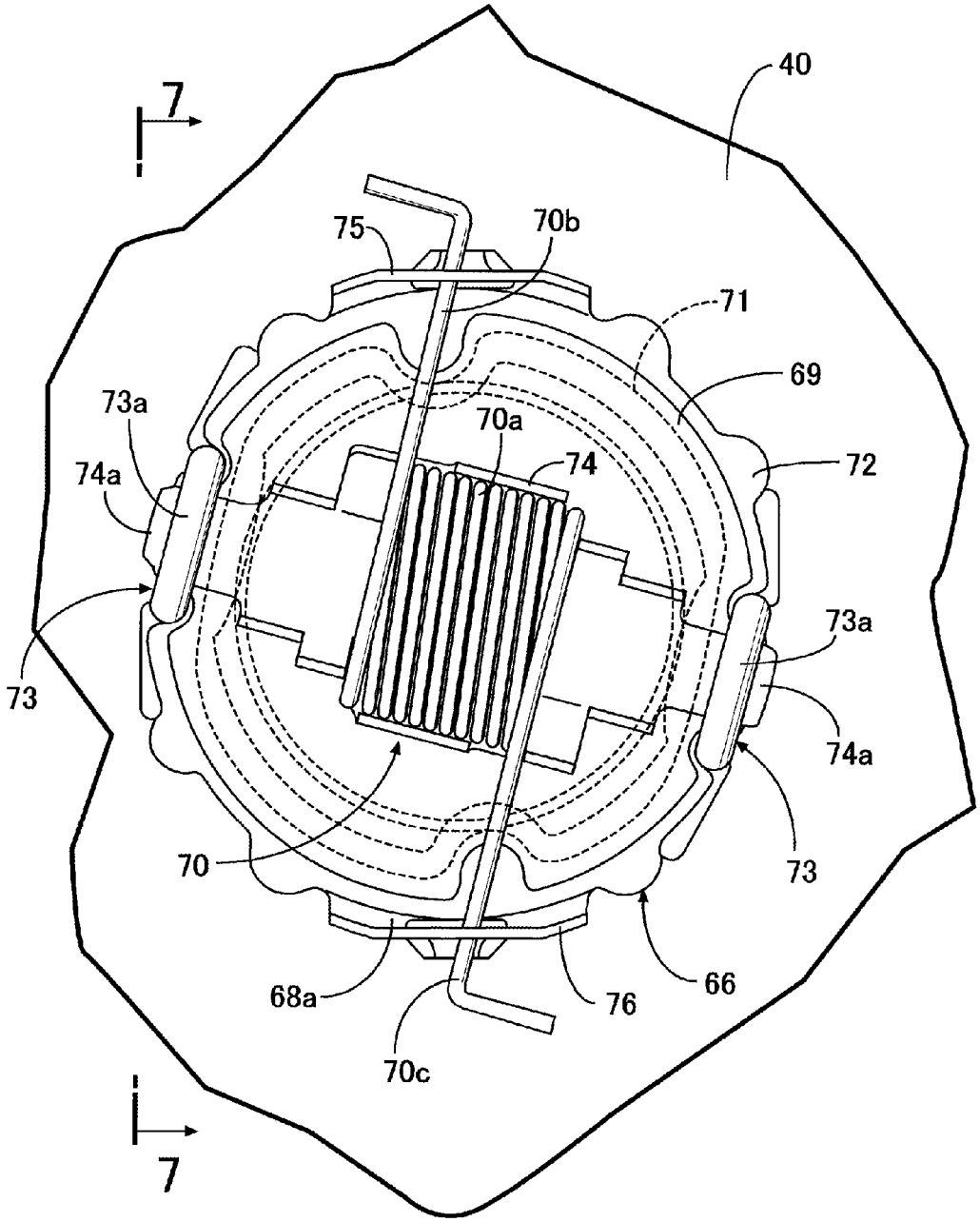
FIG. 6 is a view of a relief valve as seen from the direction of arrow 6 of FIG. 2.

Referring to FIGS. 4 and 5, the first and second separators 39, 40 forming the first exhaust-gas chamber 36 therebetween, which is, of the first to third exhaust-gas chambers 36, 37, 38, an exhaust-gas chamber at the most upstream end in the flow direction 65 of exhaust gas, are fixed to the outer case member 32 of the casing 30 with a reinforcing plate member 44, which is common to the separators 39, 40, interposed therebetween. Thus, in a portion of the reinforcing plate member 44 which is in contact with an inner surface of the outer case member 32, for example, two through holes for welding 45, 46 are provided. In the outer case member 32, also, two through holes for welding 47, 48 corresponding to the through holes for welding 45, 46 are provided as shown in FIG. 4. Moreover, a first stay 49 is brought into contact with the inner surface of the reinforcing plate member 44. The outer case member 32, the reinforcing plate member 44, and the first stay 49 are welded together using the through holes for welding 45, 47, 46, 48.

The second collective exhaust pipe 27 passes through a portion of the inner case member 31 of the casing 30 which corresponds to the first exhaust-gas chamber 36. In the first exhaust-gas chamber 36, a catalytic converter 52 formed by filling a cylindrical case 50 with a catalyst 51 is inserted in and fixed to an open end portion of the second collective exhaust pipe 27. Moreover, a stiffening plate 53 which is brought into contact with and fastened to part of the outer circumference of the open end portion of the second collective exhaust pipe 27 is fastened to the first stay 49 fastened to the reinforcing plate member 44. Thus, the catalytic converter 52 connected to the second collective exhaust pipe 27 and housed in the first exhaust-gas chamber 36 is supported by the reinforcing plate member 44.

Moreover, a second stay 54 which is in contact with the inner surface of the inner case member 31 is fastened to a surface of the outer circumference of the open end portion of the second collective exhaust pipe 27, the surface facing the inner case member 31 of the casing 30. The second stay 54 is welded to the inner case member 31 using a through hole for welding 55 provided in a portion of the inner case member 31 which corresponds to the second stay 54.

Referring to FIG. 2 again, a first communicating pipe 56 which passes through the first separator 39 such that a communicative connection is established between the first exhaust-gas chamber 36 and the second exhaust-gas chamber 37 is fastened to the first separator 39, and a second communicating pipe 57 which passes through the first and second separators 39, 40 such that a communicative connection is established between the second exhaust-gas chamber 37 and the third exhaust-gas chamber 38 is fastened to the first and second separators 39, 40.

Moreover, a tail pipe 58 which passes through the third separator 41 and the end wall member 42 such that the third exhaust-gas chamber 38 is opened to the outside is fastened to the third separator 41, and an exhaust-gas control pipe 59 which passes through the third separator 41 such that one end of the exhaust-gas control pipe 59 is opened to the third exhaust-gas chamber 38 is also fastened to the third separator 41. Also, the degree of opening of an open portion at the other end of the exhaust-gas control pipe 59 is controlled by an exhaust-gas control valve 61 fastened to a valve stem 60 rotatably supported by the outer case member 32 of the casing 30. A guide tube 63 which allows a cable (not shown) connected to a lever 62 fastened to the valve stem 60 to be inserted therethrough is fastened to an upper portion of the casing 30.

Referring to FIGS. 6 to 9, a relief valve 66 is installed between, of the first to third exhaust-gas chambers 36, 37, 38 formed in the casing 30, the exhaust-gas chamber on the upstream side and the exhaust-gas chamber on the downstream side in the flow direction 65 of exhaust gas. In this embodiment, the relief valve 66 is installed between the first exhaust-gas chamber 36 at the most upstream end in the flow direction 65 and the third exhaust-gas chamber 38 at the most downstream end in the flow direction 65.

This relief valve 66 includes a cylindrical tube member 68 fixed to the second separator 40, which is at least one separator of the first to third separators 39, 40, 41, such that a gas passage 67 is formed between the first and third exhaust-gas chambers 36, 38; a shutter member 69 placed to face an exit of the gas passage 67 to the third exhaust-gas chamber 38; a spring 70 provided between the tube member 68 and the shutter member 69 to bias the shutter member 69 in such a direction that the gas passage 67 is closed; a ring plate 71 fixed to an end portion of the tube member 68 on the third exhaust-gas chamber 38 side so as to surround the exit of the gas passage 67; and a seal member 72 fastened to the shutter member 69 so that an outer circumferential portion of the seal member 72 can come in contact with the ring plate 71.

The tube member 68 passes through the second separator 40 with one end of the tube member 68 opened to the first exhaust-gas chamber 36. An open end of this tube member 68 to the third exhaust-gas chamber 38 has a flange portion **68*a* provided integrally therewith. The flange portion 68*a* extends outward in the radial direction. The shutter member 69 is formed into the shape of an approximately circular disc to face the flange portion 68*a* at the other end of the tube member 68. Moreover, a pair of guide members 73, 73 are fastened to the outer circumference of the flange portion 68*a* at the other end of the tube member 68 so that the guide members 73, 73 are located on a diametrical line of the tube member 68. Each of the guide members 73, 73 is made by forming a metal rod into an approximately U shape by bending such that of the guide member 73 has a closed end portion 73*a* at the opposite side from the second separator 40**.

A spring case 74 is fastened to the opposite surface of the shutter member 69 from the tube member 68. This spring case 74 has a pair of protruding portions **74*a*, 74*a* provided integrally therewith. The protruding portions 74*a*, 74*a* are inserted into the guide members 73 . . . to guide opening and closing actions of the shutter member 69, and come in contact with the closed end portions 73***a* . . . of the guide members 73 . . . to restrict the open-side end of movement of the shutter member 69.

The spring 70 has a coil portion 70*a* held by the spring case 74 and a pair of extending arm portions 70*b*, 70*c* extending from two ends of the coil portion 70*a*. On the other hand, the outer circumference of the flange portion 68*a* at the other end of the tube member 68 has engaging protrusions 75, 76 provided integrally therewith. The engaging protrusions 75, 76 allow tip portions of the two extending arm portions 70*b*, 70*c* to be inserted therethrough and engaged therewith. Thus, the spring 70 is biased in such a direction that the shutter member 69 is pressed toward the flange portion 68*a* at the other end of the tube member 68, i.e., in such a direction that the gas passage 67 in the tube member 68 is closed.

Figure 10:
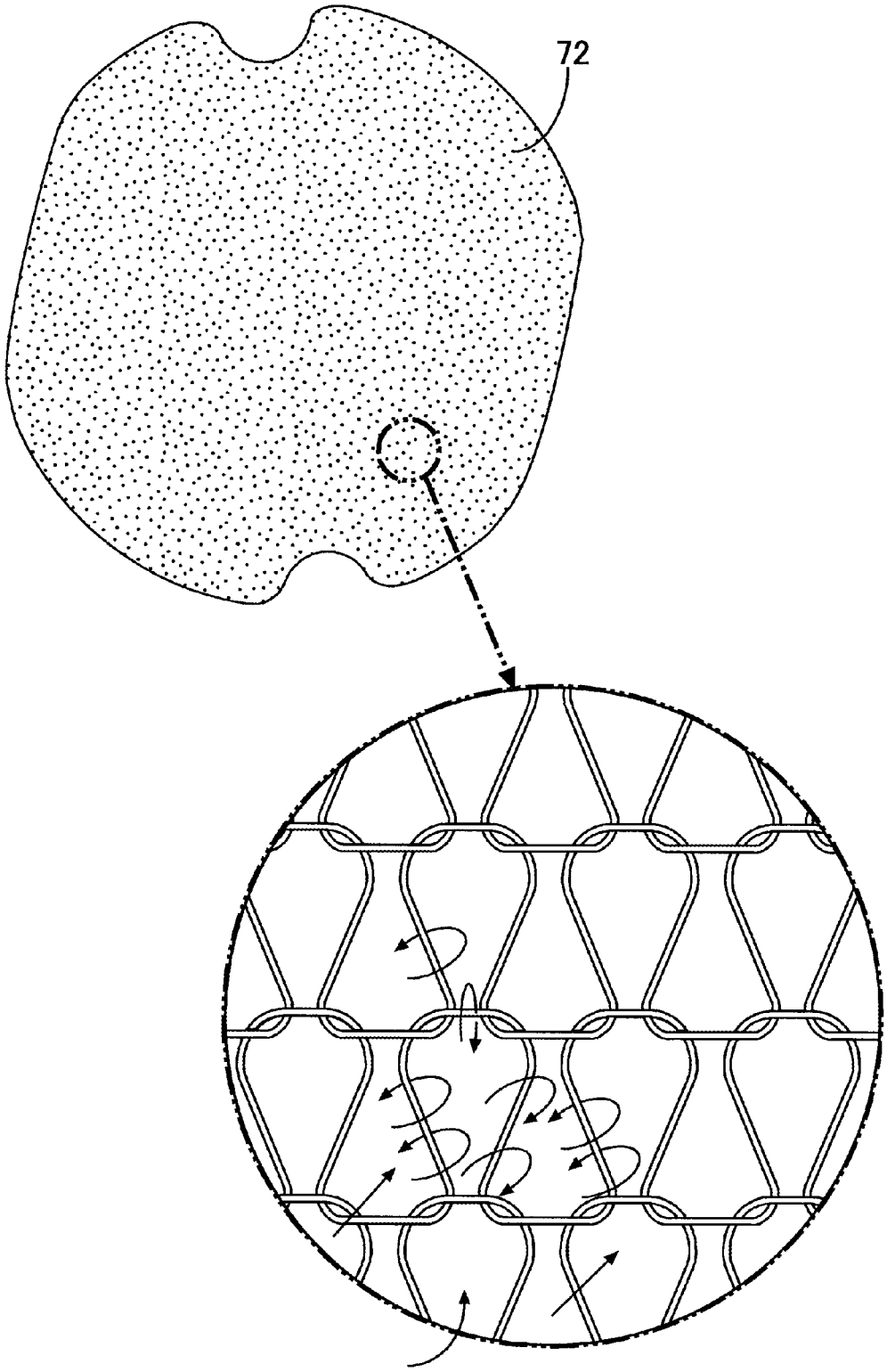
FIG. 10 is a front view of a seal member.
Figure 11:
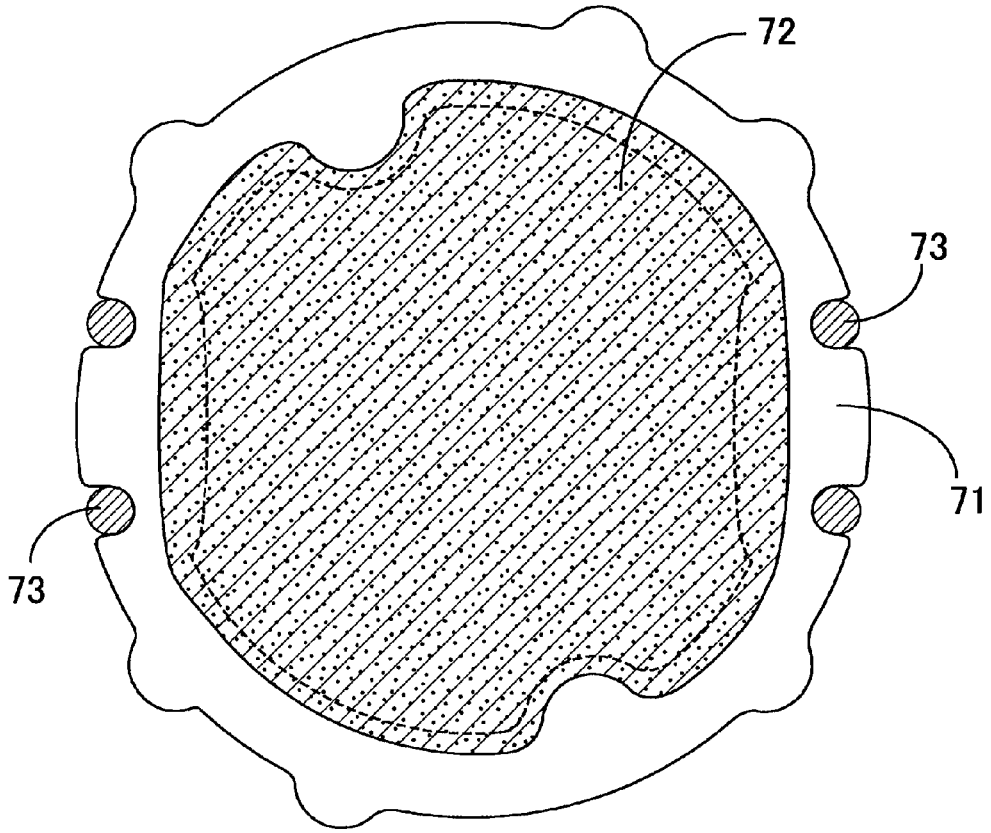
FIG. 11 is a cross-sectional view showing the seal member and a ring plate taken along line 11-11 of FIG. 7.

Referring to FIGS. 10 and 11, the ring plate 71 is formed to have an outer circumference larger than the outer circumference of the shutter member 69, and fixed to the flange portion 68*a* at the other end of the tube member 68 to surround the exit of the gas passage 67. Moreover, the seal member 72 is made of a metal mesh material, formed into a disc shape to cover the exit of the gas passage 67 in the tube member 68, and fastened to a surface of the shutter member 69 which faces the tube member 68.

Figure 7:
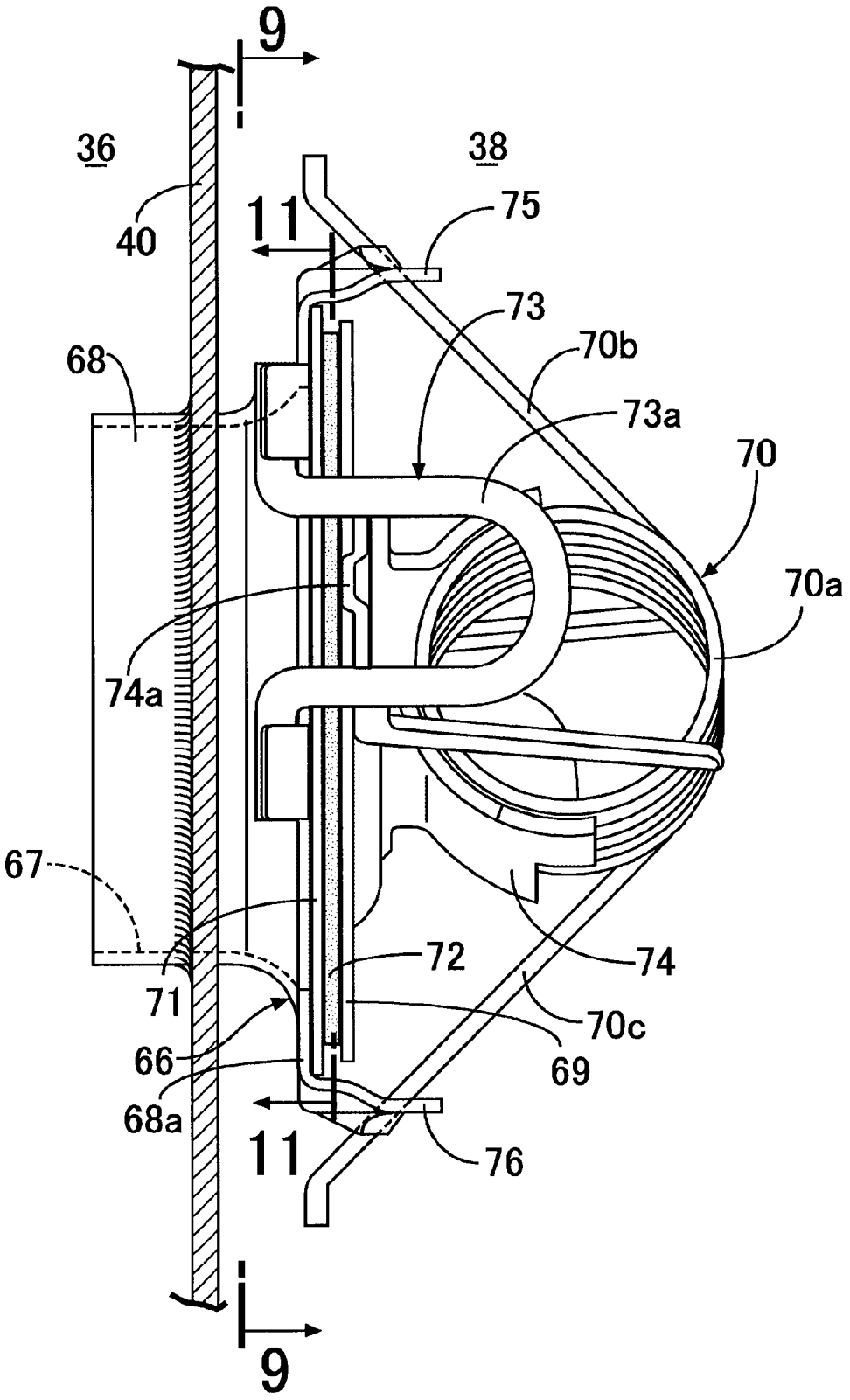
FIG. 7 is a cross-sectional view of the relief valve in a closed state taken along line 7-7 of FIG. 6.
Figure 8:
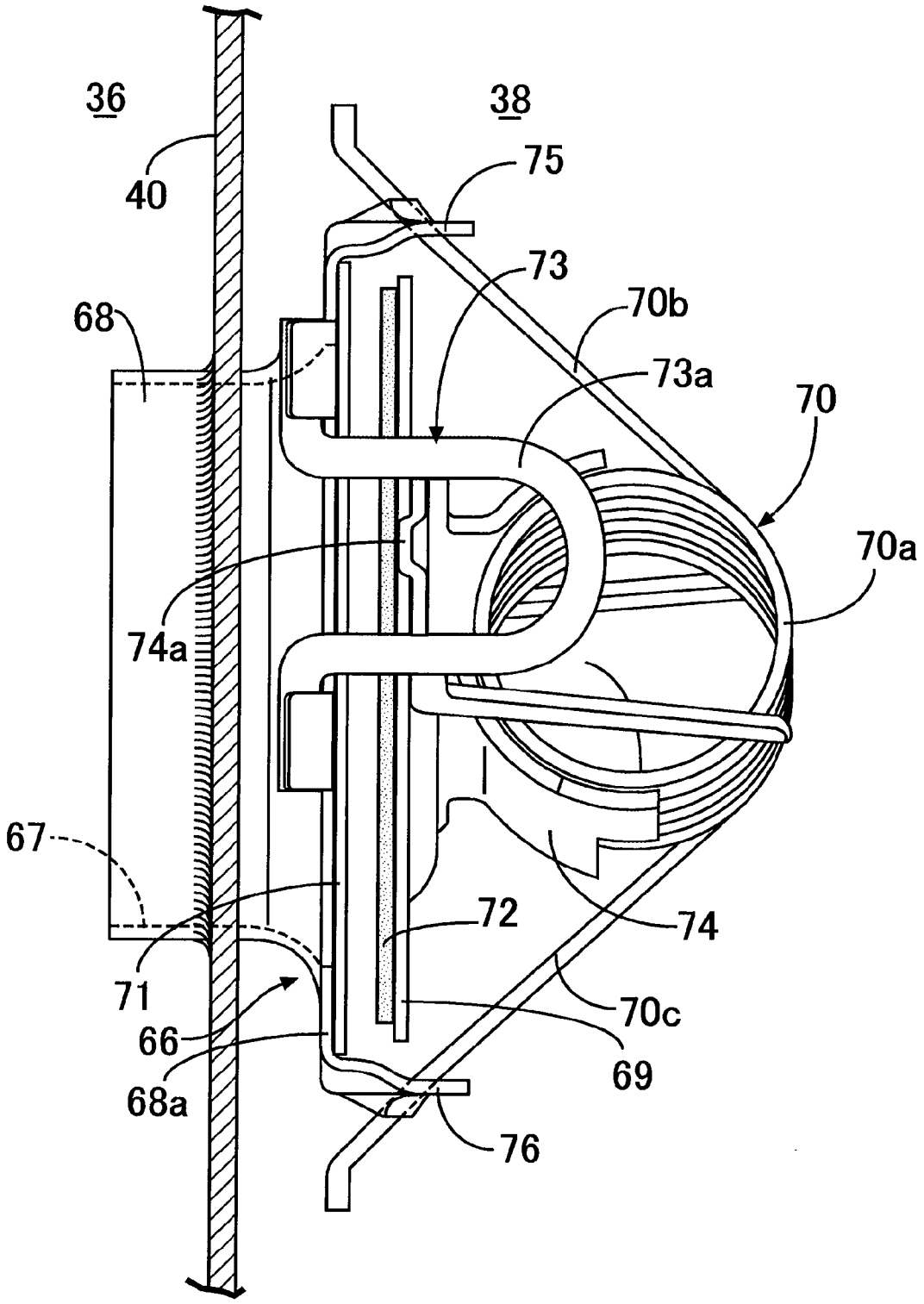
FIG. 8 is a cross-sectional view of the relief valve in an open state corresponding to FIG. 7.
Figure 9:
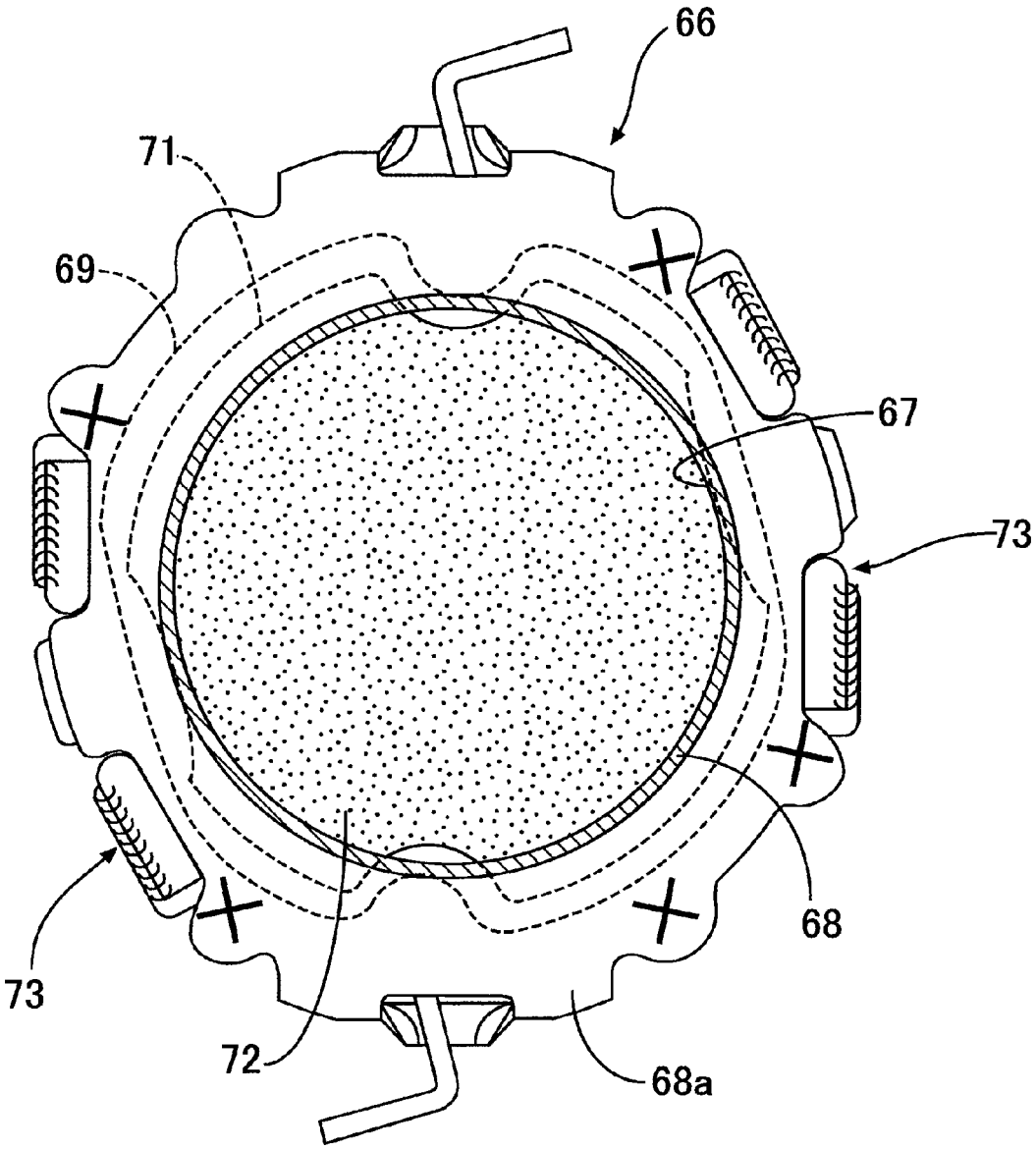
FIG. 9 is a cross-sectional view taken along line 9-9 of FIG. 7.

In the above-described relief valve 66, when the pressure of the first exhaust-gas chamber 36 is less than a predetermined value, the shutter member 69 is biased with the spring 70, thus the seal member 72 is in contact with the ring plate 71 fastened to the flange portion 68*a* of the tube member 68 as shown in FIG. 7, and accordingly the gas passage 67 in the tube member 68 is shut off. On the other hand, when the pressure of the first exhaust-gas chamber 36 is a predetermined value or higher, the shutter member 69 moves away from the flange portion 68*a* against the biasing force of the spring 70 as shown in FIG. 8. Thus, the seal member 72 is detached from the ring plate 71 to open the gas passage 67.

Referring to FIG. 2 again, among the first to third separators 39 to 41, the second separator 40 supports the tube member 68 and faces the first exhaust-gas chamber 36. A cover member 77 is fixed to the second separator 40 so as to cover the open end of the tube member 68 to the first exhaust-gas chamber 36. The cover member 77 is formed into a bowl shape in which the cover member 77 on the inner case member 31 side is open to allow exhaust gas to flow from the first exhaust-gas chamber 36 to the gas passage 67.

Next, operation of this embodiment will be described. Since the seal member 72 of the relief valve 66 installed between the first and third exhaust-gas chambers 36, 38 is made of a metal mesh material, and formed into a disc shape to cover the exit of the gas passage 67 in the tube member 68 fastened to the second separator 40 between the first and third exhaust-gas chambers 36, 38, the dynamic pressure acts on the shutter member 69 through the seal member 72 even in such a rare case where the dynamic pressure of exhaust gas in the first exhaust-gas chamber 36 instantaneously increases. When the exhaust gas passes through a mesh portion of the seal member 72, the exhaust gas collides with the mesh portion, and the flow of the exhaust gas is disturbed as indicated by arrows of FIG. 10. Thus, the dynamic pressure acting on the shutter member 69 can be lowered. Accordingly, even when the dynamic pressure of exhaust gas instantaneously increases, the relief valve 66 is difficult to open, and the relief valve 66 can be accurately opened and closed.

Moreover, the first and second separators 39, 40 forming the first exhaust-gas chamber 36 therebetween are fixed to the casing 30 with the reinforcing plate member 44, which is common to these separators 39, 40, interposed therebetween. Accordingly, the rigidity of the first and second separators 39, 40 is increased, a change in the capacity of the first exhaust-gas chamber 36 associated with a change in the dynamic pressure of exhaust gas is reduced, a change in the pressure of the first exhaust-gas chamber 36 is reduced, and vibrations of the casing 30 are reduced. Thus, the occurrence of noise can be reduced.

Moreover, since the catalytic converter 52 connected to the second collective exhaust pipe 27 for introducing exhaust gas into the first exhaust-gas chamber 36 and housed in the first exhaust-gas chamber 36 is supported by the reinforcing plate member 44, the catalytic converter 52 can be supported by taking advantage of the rigidity of the reinforcing plate member 44.

Further, the cover member 77 for covering the open end of the tube member 68 to the first exhaust-gas chamber 36 is fixed to, of the first to third separators 39 to 41, the second separator 40 supporting the tube member 68 and facing the first exhaust-gas chamber 36. Accordingly, the dynamic pressure in the first exhaust-gas chamber 36 is not transmitted directly to the shutter member 69 side of the relief valve 66. Thus, the relief valve 66 can be more accurately opened and closed.

While an embodiment of the present invention has been described above, the present invention is not limited to the above-described embodiment, but various design modifications can be made thereto without departing from the invention defined by the claims.

The exhaust-gas muffler according to the embodiment includes a relief valve provided between two of a plurality of exhaust-gas chambers formed in a casing such that exhaust gas is allowed to sequentially flow therethrough, the two exhaust-gas chambers being an upstream exhaust-gas chamber on an upstream side and a downstream exhaust-gas chamber on a downstream side in a flow direction of the exhaust gas. The relief valve includes a shutter member placed to face an open end of a gas passage interposed between the upstream exhaust-gas chamber and the downstream exhaust-gas chamber, the open end of the gas passage being open to the downstream exhaust-gas chamber; a spring for biasing the shutter member in such a direction that the gas passage is closed; and a seal member fastened to the shutter member so as to be capable of coming in contact with the whole circumference of the open end of the gas passage to the downstream exhaust-gas chamber. The relief valve is configured to open when the pressure of the upstream exhaust-gas chamber is a predetermined value or higher. The seal member is made of a metal mesh material and is formed into a disc shape to cover an exit of the gas passage.

Moreover, in the exhaust-gas muffler according to the embodiment, an inside of the casing is partitioned by a plurality of separators forming the plurality of exhaust-gas chambers in the casing, a tube member forming the gas passage is fixed to at least one of the separators, and a ring plate with which an outer circumferential portion of the seal member is to come in contact is fastened to the tube member so as to surround the exit of the gas passage.

In the exhaust-gas muffler according to the embodiment, the pair of separators forming the upstream exhaust-gas chamber therebetween are fixed to the casing with a reinforcing plate member which is common to these separators.

In the exhaust-gas muffler according to the embodiment, the reinforcing plate member supports a catalytic converter housed in the upstream exhaust-gas chamber and connected to an exhaust pipe for introducing exhaust gas into the upstream exhaust-gas chamber.

Further, in the exhaust-gas muffler according to the embodiment, a cover member for covering the open end of the tube member to the upstream exhaust-gas chamber if fixed to the separator, among the plurality of separators, which supports the tube member and faces the upstream exhaust-gas chamber.

It should be noted that the second collective exhaust pipe 27 of the embodiment corresponds to an exhaust pipe, the first exhaust-gas chamber 36 of the embodiment corresponds to an upstream exhaust-gas chamber, and the third exhaust-gas chamber 38 of the embodiment corresponds to a downstream exhaust-gas chamber.

According to the exhaust-gas muffler of the embodiment, since the seal member fastened to the shutter member so as to be capable of coming in contact with the whole circumference of the open end of the gas passage to the downstream exhaust-gas chamber is made of a metal mesh material and formed into a disc shape to cover the exit of the gas passage, the dynamic pressure acts on the shutter member through the seal member even in such a rare case where the dynamic pressure of exhaust gas instantaneously. Since the exhaust gas is disturbed by the seal member made of the mesh material, the dynamic pressure acting on the shutter member can be lowered. Accordingly, even when the dynamic pressure of the exhaust gas instantaneously increases, the relief valve is difficult to open, and the relief valve can be accurately opened and closed.

Moreover, according to the exhaust-gas muffler of the embodiment, the pair of separators forming the upstream exhaust-gas chamber therebetween are fixed to the casing with the common reinforcing plate member. Accordingly, the rigidity of these two separators is increased, a change in the capacity of the upstream exhaust-gas chamber associated with a change in the dynamic pressure of the exhaust gas is reduced, a change in the pressure of the upstream exhaust-gas chamber is reduced, and vibrations of the casing are reduced. Thus, the occurrence of noise can be reduced.

In particular, according to the exhaust-gas muffler of the embodiment, since the catalytic converter is supported by the reinforcing plate member, the catalytic converter can be supported by taking advantage of the rigidity of the reinforcing plate member.

Further, according to the exhaust-gas muffler of the embodiment, the cover member is fixed to the separator supporting the tube member and facing the upstream exhaust-gas chamber, and the open end of the tube member to the upstream exhaust-gas chamber is covered with the cover member. Accordingly, the dynamic pressure in the upstream exhaust-gas chamber is not transmitted directly to the shutter member side of the relief valve. Thus, the relief valve can be more accurately opened and closed.

Obviously, numerous modifications and variations of the present invention are possible in light of the above teachings. It is therefore to be understood that within the scope of the appended claims, the invention may be practiced otherwise than as specifically described herein.

What is claimed is:

1. An exhaust-gas muffler comprising:

a relief valve provided between two of a plurality of exhaust-gas chambers formed in a casing such that exhaust gas is allowed to sequentially flow therethrough, the two of the plurality of exhaust-gas chambers being an upstream exhaust-gas chamber on an upstream side and a downstream exhaust-gas chamber on a downstream side in a flow direction of the exhaust gas, the relief valve comprising:

a shutter member placed to face an open end of a gas passage between the upstream exhaust-gas chamber and the downstream exhaust-gas chamber, the open end of the gas passage being open to the downstream exhaust-gas chamber;

a spring to bias the shutter member in a direction in which the gas passage is closed; and a seal member fastened to the shutter member so as to be capable of coming in contact with a whole circumference of the open end of the gas passage to the downstream exhaust-gas chamber, the relief valve being configured to open when pressure of the upstream exhaust-gas chamber is a predetermined value or higher, and the seal member being made of a metal mesh material and formed into a disc shape to cover an exit of the gas passage;

a pair of guide members fastened to opposite sides of the open end of the gas passage, each guide member of the pair of guide members having a U-shaped configuration with an open end portion of the U-shaped configuration fastened to the open end of the gas passage and a closed end portion of the U-shaped configuration extending away from the open end of the gas passage; and a spring case fastened to the shutter member and configured to receive a coil portion of the spring, the spring case having a pair of protruding portions that respectively protrude within the U-shaped configuration of the pair of guide members to guide opening and closing actions of the shutter member, and to come in contact with the closed end portions of the pair of guide members to restrict movement of the shutter member.

2. The exhaust-gas muffler according to claim 1, wherein an inside of the casing is partitioned by a plurality of separators forming the plurality of exhaust-gas chambers in the casing, a tube member forming the gas passage is fixed to at least one of the plurality of separators, and a ring plate with which an outer circumferential portion of the seal member is to come in contact is fastened to the tube member so as to surround the exit of the gas passage.

3. The exhaust-gas muffler according to claim 2, wherein a pair of separators forming the upstream exhaust-gas chamber therebetween are fixed to the casing with a reinforcing plate member which is common to the pair of separators.

4. The exhaust-gas muffler according to claim 3, wherein the reinforcing plate member supports a catalytic converter housed in the upstream exhaust-gas chamber and connected to an exhaust pipe to introduce exhaust gas into the upstream exhaust-gas chamber.

5. The exhaust-gas muffler according to claim 2, wherein a cover member to cover an open end of the tube member to the upstream exhaust-gas chamber is fixed to a separator which supports the tube member and which faces the upstream exhaust-gas chamber.

6. A vehicle including the exhaust-gas muffler according to claim 1.

* * * * *